US010463209B1

(12) United States Patent
Laundre

(10) Patent No.: US 10,463,209 B1
(45) Date of Patent: Nov. 5, 2019

(54) TOILET SEAT HINGE

(71) Applicant: Kohler Co., Kohler, WI (US)

(72) Inventor: Jeffrey T. Laundre, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/954,839

(22) Filed: Apr. 17, 2018

(51) Int. Cl.
*A47K 13/12* (2006.01)

(52) U.S. Cl.
CPC ..... *A47K 13/12* (2013.01)

(58) Field of Classification Search
CPC ..... A47K 13/12
USPC ..... 4/236
See application file for complete search history.

(56) References Cited

U.S. PATENT DOCUMENTS 4,639,147 A 1/1987 Schwarz
4,794,669 A 1/1989 Sanders
4,984,666 A 1/1991 Orii et al.
5,276,945 A 1/1994 Matsumura
6,913,252 B2 7/2005 Hayashi
7,578,031 B2 8/2009 Hung
8,959,717 B2 2/2015 Billings et al.
2013/0333104 A1* 12/2013 Hong ..... A47K 13/12 4/236
2015/0059072 A1* 3/2015 Jochim ..... A47K 13/10 4/236

* cited by examiner

*Primary Examiner* — Lori L Baker
(74) *Attorney, Agent, or Firm* — Foley & Lardner LLP

(57) ABSTRACT

A toilet seat hinge that includes a hinge base mountable to a toilet and including a body having a bore; a hinge pin having a first portion disposed in the bore and a second portion that extends outside of the bore, where the hinge pin is rotatable relative to the body; a damper; and a clip. The damper includes a sleeve rotatably mounted on the first portion and an arm extending radially outward from the sleeve. The clip is disposed in the bore between the body and the damper, and the damper is rotatable relative to the clip such that in a first relative position, the arm is compressed a first amount by the clip to provide a first damping force, and in a second relative position, the arm is compressed a second amount, which is greater than the first amount, by the clip to provide a second damping force.

20 Claims, 13 Drawing Sheets

TOILET SEAT HINGE

BACKGROUND

The present application relates generally to the field of hinges that pivotally couple toilet seat assemblies to toilet bases/bowls. More specifically, this application relates to toilet seat hinges having improved damping systems to prevent slamming of the seat/lid of the toilet seat assembly onto the toilet base/bowl.

SUMMARY

At least one embodiment of the application relates to a toilet seat hinge for use in rotatably coupling toilet seat assemblies to toilets. The toilet seat hinge includes a hinge base, a hinge pin, a damper, and a clip. The hinge base is mountable to a toilet and includes a body having a bore. The hinge pin is rotatable relative to the body and includes a first portion, which is disposed in the bore, and a second portion, which extends outside of the bore and is configured to engage part of a toilet seat assembly. The damper includes a sleeve rotatably mounted on the first portion; and an arm extending radially outward from the sleeve. The clip is disposed in the bore between the body and the damper, and the damper is rotatable relative to the clip such that in a first relative position, the arm is compressed a first amount by the clip to provide a first damping force, and in a second relative position, the arm is compressed a second amount by the clip to provide a second damping force. The second amount is greater than the first amount.

At least one embodiment relates to a toilet seat hinge that includes a hinge base comprising a body having a bore; a hinge pin having a portion disposed in the bore, wherein the hinge pin is rotatable relative to the body; a damper that is rotatably mounted on the portion of the hinge pin and that includes a plurality of arms extending radially away from the hinge pin; and a clip disposed in the bore between the body and the damper, where the clip includes a body and a plurality of projections extending inwardly from the body of the clip. Rotation of the damper relative to the clip with the plurality of arms contacting the plurality of projections provides a first damping force, and rotation of the damper relative to the clip with the plurality of arms separated from the plurality of projections provides a second damping force that is less than the first damping force.

BRIEF DESCRIPTION OF THE DRAWINGS

FIG. 21 is a plan view of a damper assembly for use with the toilet seat hinge shown in

FIG. 20.

DETAILED DESCRIPTION

Referring generally to the Figures, disclosed in this application are toilet seat hinges having improved damping systems. Damping systems can employ hydraulics, springs, or other elements to prevent slamming of the toilet seat by damping movement (e.g., closing movement) of the seat. The toilet seat hinges disclosed herein include a rotational damper that provides a force (e.g., damping force, friction force, etc.) during rotation to prevent, for example, the toilet seat and/or lid from being slammed onto the toilet bowl during closing and/or the toilet tank during opening.

Figure 1:
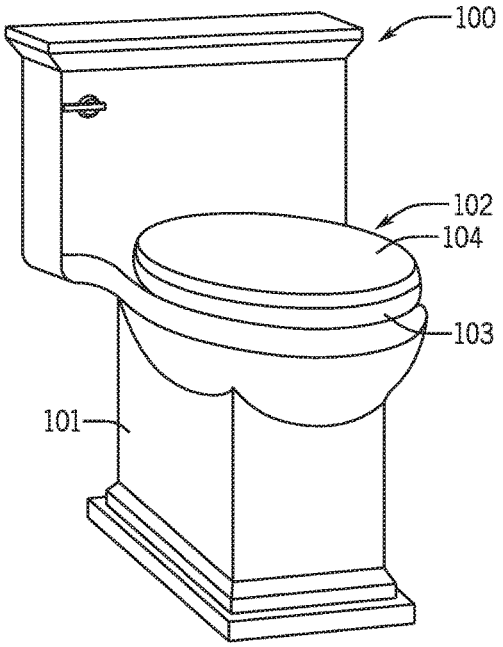
FIG. 1 is a perspective view of a toilet having a toilet seat hinge, according to this application.
Figure 2:
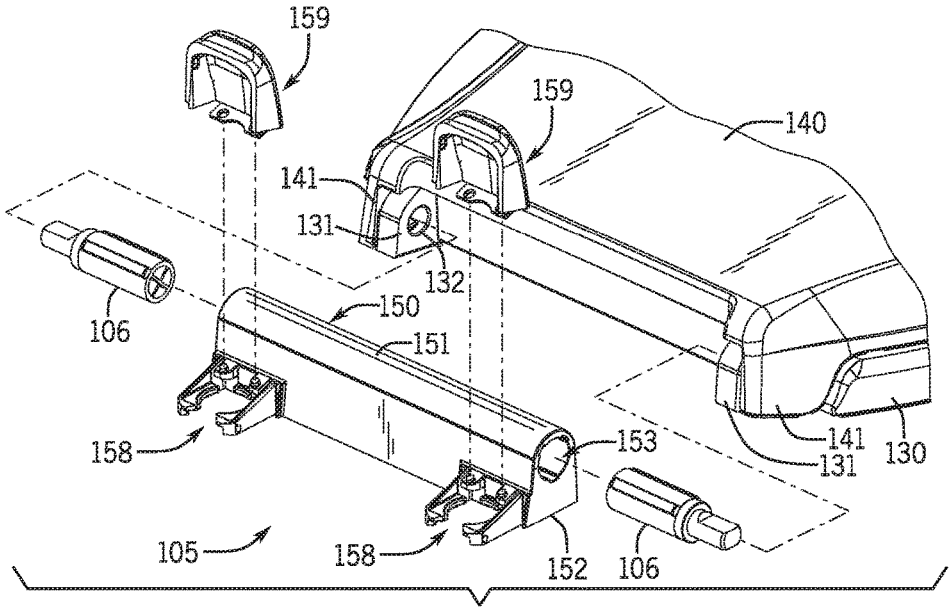
FIG. 2 is a partially exploded perspective view of an exemplary embodiment of a toilet seat and hinge.

FIGS. 1 and 2 illustrate an exemplary embodiment of a toilet 100 that includes a toilet base 101, which has a bowl, and a toilet seat assembly 102 operatively coupled to a surface (e.g., a deck, a ledge, etc.) of the toilet base 101 to selectively cover/provide access to the bowl. The toilet seat assembly 102 includes a seat 103 configured to support a person, a lid 104 covering the seat 103 in FIG. 1, and a hinge 105 (e.g., toilet seat hinge, hinge assembly, etc.) that rotatably couples the seat 103 and the lid 104 to the toilet base 101 and each other. As shown in FIG. 2, the seat 103 includes a body 130 (e.g., an annular support) for supporting a person and two opposing and spaced apart collars 131, with each collar 131 being configured to receive part of a hinge pin 106 of the hinge 105 (e.g., an outside shoulder) to rotatably couple the seat 103 to the hinge 105. Each collar 131 is shown to include a bore 132 that extends inwardly from an interior surface of the collar 131 and receives a shoulder of the hinge pin 106. Each collar 131 can rotatably couple the lid 104 to the seat 103. As shown, the lid 104 includes a body 140 (e.g., a covering portion) and two opposing and spaced apart ears 141 extending from the body 140 for rotatably coupling to one of the two collars 131. By way of example, one of the ear 141 and the collar 131 includes a post for engaging a bore in the other element. It is noted that the toilet seat assembly and the toilet seat hinges disclosed herein may be employed with any type of toilet (e.g., one-piece toilets, two-piece toilets, skirted toilets, smart toilets, etc.) and that the toilet 100 shown in FIG. 1 is only exemplary. It is further noted that the toilet seat hinges disclosed herein may be employed with any type of toilet seat assembly as well as other toilet attachment assemblies (e.g., bidet assemblies, sprayers, heated seats, smart devices, etc.).

Figure 3:
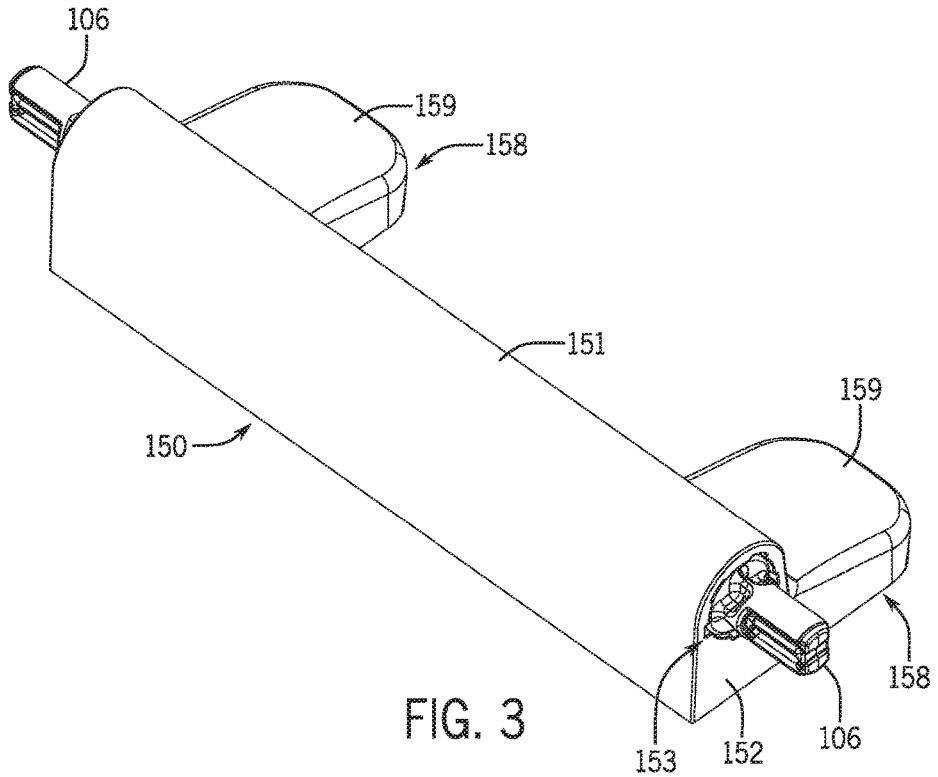
FIG. 3 is a perspective view of an exemplary embodiment of a toilet seat hinge, according to this application.

As shown in FIGS. 2 and 3, the hinge 105 includes a hinge base 150 that is mountable to the toilet 100, such as to the toilet base 101. The hinge base 150 includes an elongated body 151 (e.g., a hinge cover) and a base member 152, which is configured to rest on part of the toilet 100 can be formed integrally with or separately from the body 151. The body 151 alone or in combination with the base member 152 define a bore 153 extending longitudinally within the body 151. Each bore 153 is accessible through an opening in a side of the body 151. The bore 153 can extend through the entire body 151 such that two hinge pins can engage opposite ends of the same bore 153, or the hinge base 150 can include two separated bores 153 with one bore 153 extending longitudinally into each side/end of the hinge base 150. Also shown in FIGS. 2 and 3, each bore 153 receives part of a hinge pin 106 (e.g., an inside shoulder) to rotatably couple the seat 103 and the lid 104 to the hinge base 150. The hinge base 150 includes one or more mounts for securing the hinge 105 to the toilet 100 through one or more connectors (e.g., fasteners, fastening assemblies, hinge locks, etc.). As shown in FIG. 2, the hinge base 150 includes two spaced apart mounts 158 extending from a side of the body 151, where each mount 158 receives a connector to secure the mount 158 (and the hinge base 150) to the toilet 100. Each mount 158 can be concealed by a cover 159, as shown in FIG. 3, and the cover 159 can be rotatably coupled to the hinge base 150, if provided.

Figure 4:
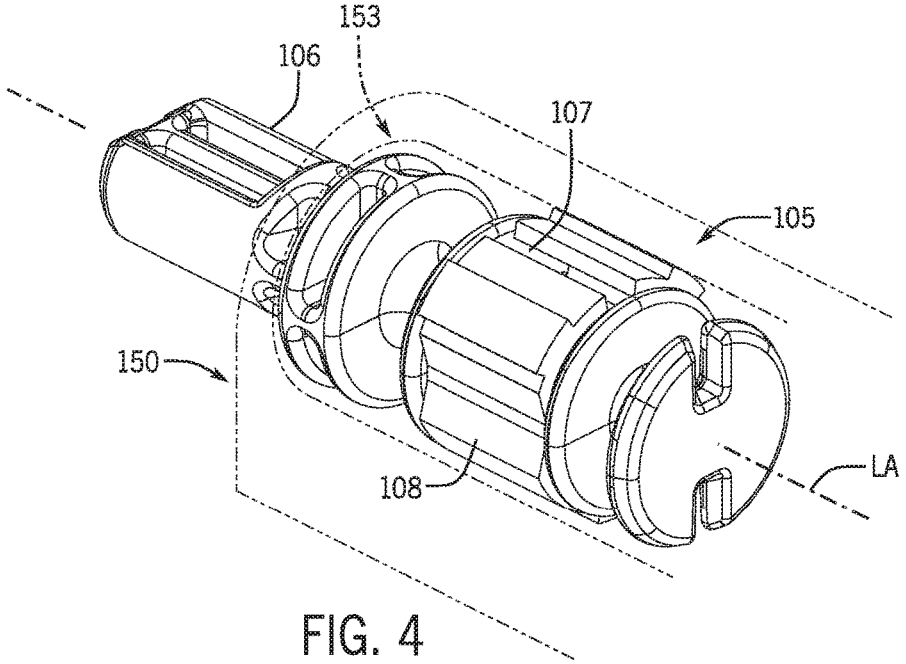
FIG. 4 is a perspective view of part of the toilet seat hinge shown in FIG. 3.
Figure 5:
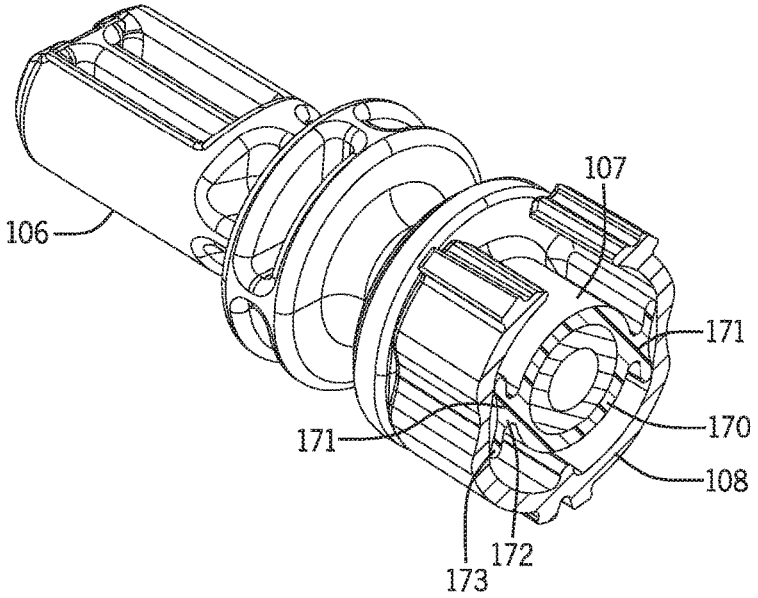
FIG. 5 is a perspective view of an exemplary embodiment of a damper assembly for use with the toilet seat hinge shown in FIG. 3.
Figure 6:
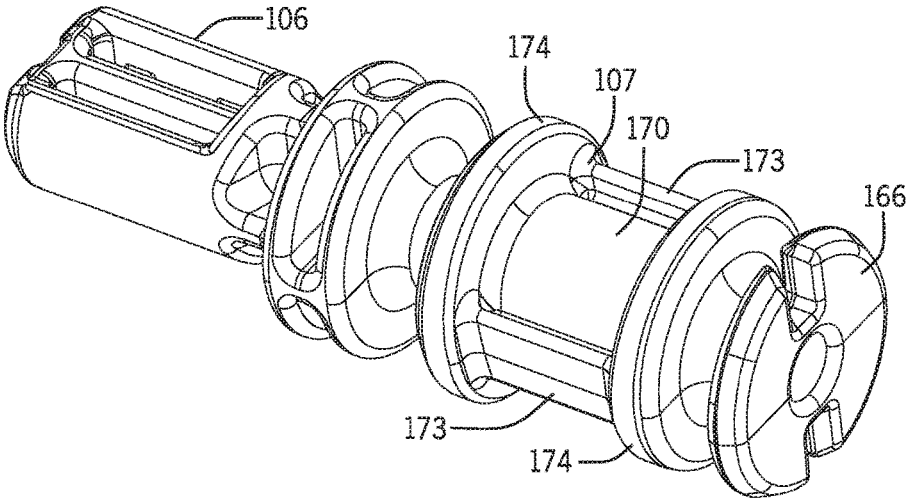
FIG. 6 is a perspective view of the damper pin and the damper shown in FIG. 5.

As shown in FIG. 4, the hinge 105 includes the hinge pin 106 (e.g., a damper pin) rotatably disposed in the bore 153 of the body 151, a damper 107 disposed in the bore 153 and rotatably mounted on the hinge pin 106, and a clip 108 disposed in the bore 153 between the body 151 and the damper 107. The clip 108 couples to the inner wall of the body 151 (that defines the bore 153) to secure the hinge pin 106 and the damper 107 in place in the bore 153 while allowing relative rotation between the damper 107 and the clip 108, as well as the hinge pin 106 and the clip 108. The clip 108 can retain the hinge pin 106 and the damper 107 along a longitudinal axis LA and allow rotation of the hinge pin 106 and the damper 107 about the longitudinal axis LA. FIG. 5 illustrates the hinge pin 106, the damper 107, and the clip 108 coupled together with a section view showing the cutting plane (the end of the parts) for FIGS. 9-12, which are discussed below. FIG. 6 illustrates the damper 107 coupled to the hinge pin 106 without the clip 108.

Figure 7:
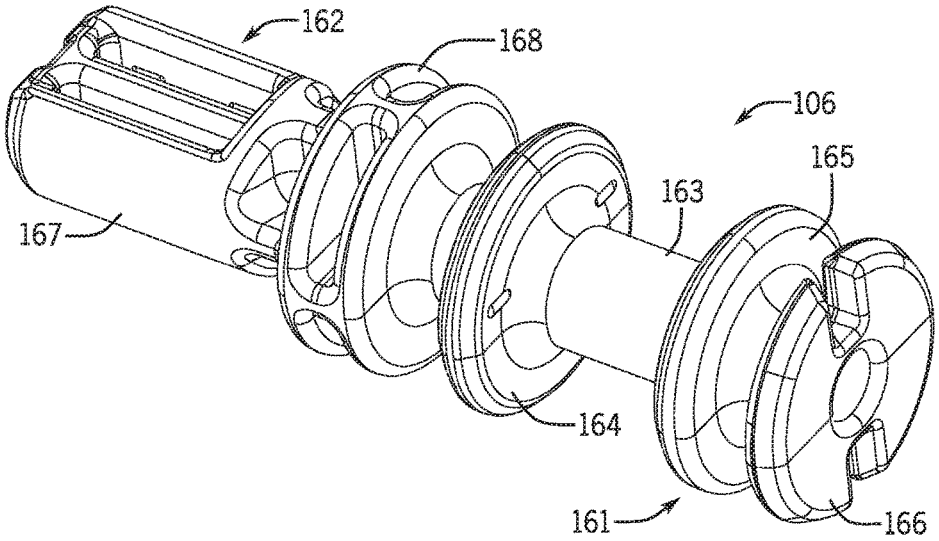
FIG. 7 is a perspective view of the damper pin shown in FIGS. 5 and 6.

FIG. 7 illustrates an exemplary embodiment of the hinge pin 106 that includes a first portion 161, which is configured to be disposed in the bore 153, and a second portion 162, which is configured to extend outside of the bore 153 (i.e., beyond the body 151) to engage part of the toilet seat assembly (e.g., the toilet seat base, the collar 131, etc.). The first portion 161 includes a shaft 163 and one or more shoulders extending radially outward from the shaft 163. As shown in FIG. 7, a first annular shoulder 164 and a second annular shoulder 165, which is spaced apart from the first annular shoulder 164, extend from first and second parts (e.g., ends) of the shaft 163. The shaft 163 can be solid or hollow (as shown) and has an outer diameter that is sized to complement the damper 107. The spacing distance between the shoulders 164, 165 is sized based on a longitudinal length of the damper 107. The shoulders 164, 165 retain the damper 107 on the shaft 163 longitudinally. The first portion 161 can also include an outer shoulder 166, which incrementally creates a sealing surface that helps prevent debris and fluid from entering the hinge base. An interference between a radially outer surface of the shoulder 166 and the hinge base 150 helps create an incremental frictional resistance for torque resistance, which can be used to enable improved seat layback (i.e., where the seat resists falling down after rotating open to about ninety degrees (~90°). In addition, the shoulder 166 can provide radial compression forces based on fit and geometry (e.g., the shape of the shoulder 166 can be oval to be variable) between the hinge base 150 and pin 106 that can lead to additional torque resistance.

The second portion 162 of the hinge pin 106 is configured to couple to the seat 103 and/or the lid 104. As shown in FIG. 7, the second portion 162 includes a post 167 that engages the bore 132 in a collar 131 of the seat 103. The post 167 can be key-way shaped (e.g., D-shaped, double d-shaped, splined, etc.) so that rotation of the seat 103 in-turn rotates the hinge pin 106 through the post 167. Also shown, the second portion 162 includes a shoulder 168, which can engage the bore 153 or a portion thereof (e.g., the post 167 can engage an inner portion of the bore 153 having a complementary shape to the post, and the shoulder 168 can engage an outer portion of the bore 153). It is noted that the first and second portions 161, 162 can be integrally formed as one part or separately formed and coupled together.

Figure 11:
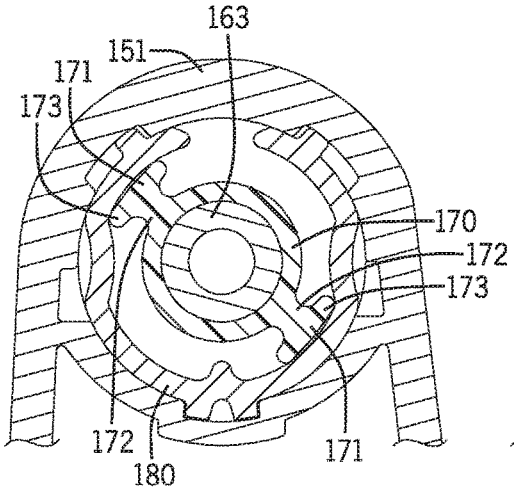
FIG. 11 is a cross-sectional view of the toilet seat hinge shown in FIG. 3 through the damper assembly in a damping position.

As shown in FIGS. 5 and 6, the damper 107 includes a tubular body 170 that is shown configured as a sleeve, which is rotatably mounted on the shaft 163 of the first portion 161 of the hinge pin 106. As shown in FIGS. 6 and 11, the body 170 surrounds a portion (e.g., of the shaft 163) of the hinge pin 106. Extending radially outward from the body 170 is one or more arms 171. As shown in FIG. 5, a first arm 171 extends radially outward from a first location on the body 170 and a second arm 171 extends radially outward from a second location on the body 170. The two arms 171 can extend radially outward from two opposite sides of the body 170, so that the two arms 171 are generally 180 degrees (180°) apart. Each arm 171 is configured to be compressed by the clip 108 (e.g., a portion thereof) by a first amount (of compression) in a first relative position between the clip 108 and the damper 107, and each arm 171 is configured to be compressed by the clip 108 by a second amount (of compression), which is different than the first amount, in a second relative position between the clip 108 and the damper 107. Also shown in FIG. 5, each arm 171 is substantially "T" shaped having a radial member 172, which extends radially from the sleeve, and a transverse member 173, which is disposed at an end (e.g., an outer end) of and extends transverse to the radial member 172. The outer surface of each transverse member 173 can be flat or can be semi-circular (e.g., having a diameter that nests with the inner diameter of the clip 108). It is noted that the damper 107 can include one arm 171 or more than two arms 171, and the number of arms 171 as well as the configuration (e.g., size, shape, material, etc.) of each arm can be tailored to provide a desired/designed damping force and/or friction force based on the application of the damper assembly. The damper 107 can optionally, include a shoulder 174 on each end of the body 170. As shown in FIG. 6, each shoulder 174 is annular in shape and located proximate to (e.g., abuts) one of the first and second shoulders 164, 165 of the hinge pin 106.

The damper 107 is made from or includes a compliant (e.g., compressible, resilient, etc.) material that elastically deforms under the subjected load conditions (e.g., the damper compresses under compression loading from the clip) to aid in damping to prevent slamming of the seat/lid. According to at least one non-limiting example, the damper 107 is made from a thermoplastic elastomer (TPE) that is over-molded onto the hinge pin 106, which is made from or includes a material that is more rigid than the damper, such that the damper 107 seals without bonding to the hinge pin 106 to allow the damper 107 to rotate relative to the hinge pin 106. However, according to other non-limiting examples, the damper 107 can be made from or can include a thermoplastic polyurethane (TPE), such as a TPE/TPU resin; a thermoplastic vulcanizate (TPV), such as santoprene; any combination of these materials; or other suitable materials. For example, a damper (e.g., damper 107) including a TPV resin having between 70-90 durometer advantageously resisted bonding to a hinge pin (e.g., pin 106) including a polybutylene terephthalate (PBT) substrate resin and had a surface grip that was able to be tuned to release initially after molding and yet have enough "grip" (e.g., adhesion) while in rotation during use. Further, compression set (e.g., from the compression due to the clip) for TPV was improved over typical TPE. Generally, elastomers having relative low compression set and relative high tear resistance performance are believed to provide consistent frictional forces resulting in consistent torque resistance over time. It is noted that other materials and methods can be employed for the dampers, as the dampers of this application are not limited to the exemplary materials noted herein. For example, depending on the pins' (e.g., hinge pins) substrate material and the geometry/interference fit condition and the torque resistance required, the damper material could be other elastomer materials beyond those described herein. Even thermoset elastomers, such as silicon and neoprene, could provide alternate chemical resistances and resistance to wear performance to be applicable for use in the dampers of this application.

Figure 8:
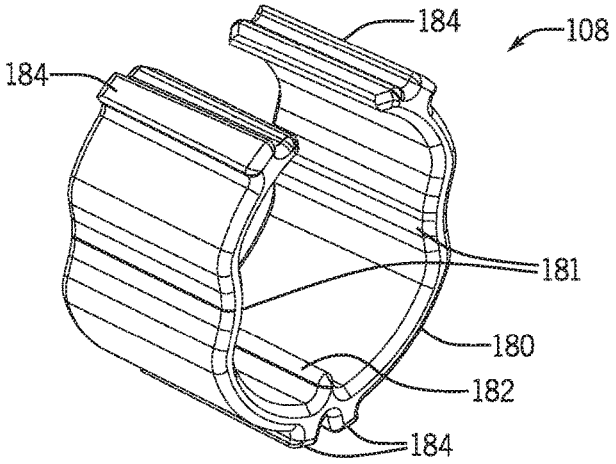
FIG. 8 is a perspective view of the clip shown in FIG. 5.
Figure 9:
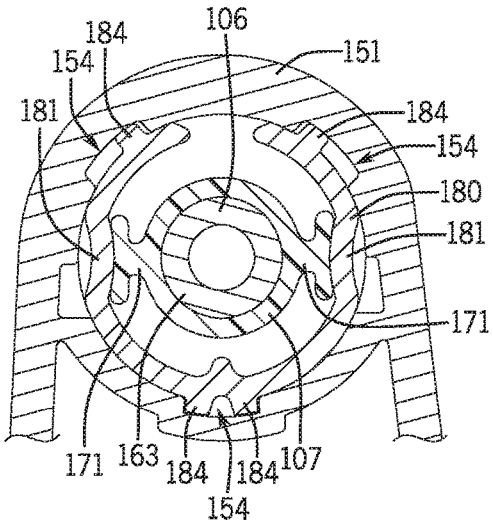
FIG. 9 is a cross-sectional view of the toilet seat hinge shown in FIG. 3 through the damper assembly in a closed position of the seat.
Figure 10:
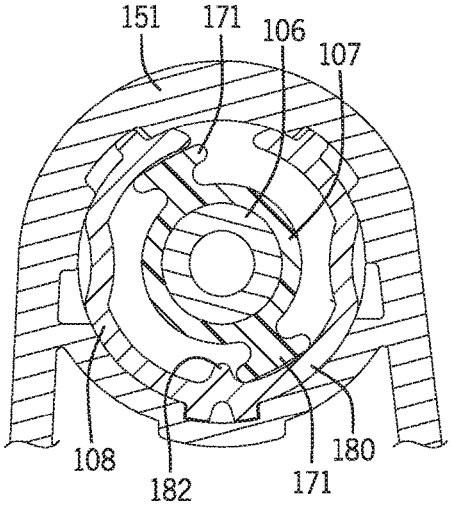
FIG. 10 is a cross-sectional view of the toilet seat hinge shown in FIG. 3 through the damper assembly in an open position of the seat.
Figure 12:
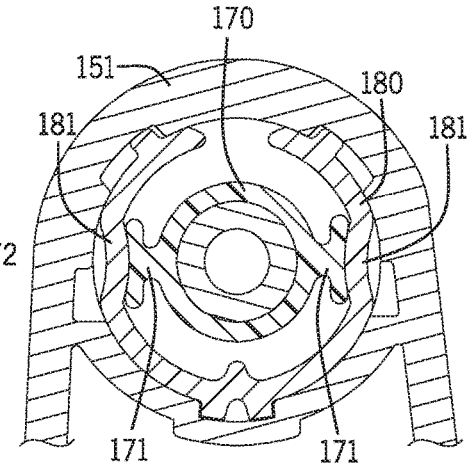
FIG. 12 is another cross-sectional view of the toilet seat hinge shown in FIG. 3 through the damper assembly in the closed position of the seat.

FIG. 8 illustrates an exemplary embodiment of the clip 108 that includes a generally annular body 180 (e.g., a majority of the body is annular) having an outer diameter, which nests with the inner surface of the hinge base 150 that defines the bore 153, and an inner diameter, which is sized based on a radial length between the two transverse members 173 of the damper 107. As shown in FIG. 10, the radial length can be less/shorter than the inner diameter so that the arms 171 of the damper 107 do not contact the portions of the body 180 having the inner diameter (i.e., there can be a gap between the arms 171 and the body 180 at locations having the inner diameter). The clip 108 includes one or more damping features that are configured to contact (e.g., and compress) the arms 171 of the damper 107 during certain ranges of travel of the damper 107 relative to the hinge pin 106 to provide damping/friction that resists rotation of the hinge pin 106 relative to the body 151 of the hinge base 150. As shown in FIGS. 5 and 9, the clip 108 includes two damping features located at two diametrically opposite locations of the body 180, where each damping feature is configured as a ramped surface 181 (e.g., curved portion, arcuate portion, concave portion, etc.) that is inwardly curved and that extends radially inside of the inner surface (e.g., inner diameter) of the body 180 and in a direction parallel to the longitudinal axis. Accordingly, the clip 108 includes two ramped surfaces 181 extending inwardly of an inner surface of the body 180 from two separate locations of the body 180. As shown in FIGS. 9 and 12, the ramped surfaces 181 project radially inward far enough to create a predetermined interference fit with the arms 171 of the damper 107, such that when the arms 171 are radially aligned with the ramped surfaces 181, each arm 171 is compressed by a predetermined amount (e.g., distance) to provide the desired damping/friction force(s). It is noted that the clip 108 can include a fewer number or a greater number of ramped surfaces 181, which may be the same as or different from the number of arms 171. As shown in FIG. 10, the clip 108 includes a projection 182 that extends both radially inward from the inner diameter of the body 180 and along a length (in the longitudinal direction) of the clip 108 to limit the rotational travel of the damper 107. Thus, the projection 182 is a rotational stop.

Also shown in FIG. 8, the clip 108 can be configured as a snap-ring (e.g., C-clip, C-ring, etc.) having open ends (e.g., a longitudinal gap separating the two ends of the annular body 180) to allow the clip 108 to be compressed diametrically (e.g., from a squeezing action) to assemble the clip 108 into the bore 153. The clip 108 includes one or more tabs 184, where each tab 184 extends both radially outward from the outer diameter of the body 180 and along the length of the clip 108. As shown in FIGS. 8 and 9, the clip 108 includes a tab 184 proximate each of the two ends of the body 180, as well as two tabs 184 diametrically opposite the opening between the two ends of the body 180. Although, each tab 184 is shown to have the same size (e.g., angular width), the tabs 184 can be configured having different sizes, such as to drive an alignment of the clip 108 relative to the body 151 of the hinge base 150. The tabs 184 also prevent rotation of the clip 108 relative to the hinge base 150. As shown best in FIGS. 9-12, the hinge base 150 has a plurality of channels 154 aligned at different angular locations around the inner diameter, where each channel 154 receives one tab 184. Each channel 154 extends radially outward from the bore 153 into the body 151 so that the channel 154 has an outer diameter that is greater than the diameter of the bore 153.

FIGS. 9-12 illustrate the hinge 105 in various positions of operation. As shown in FIG. 9, the arms 171 of the damper 107 are generally aligned with the ramped surfaces 181 of the clip 108 in a closed position, which corresponds to a closed position of the seat 103. As shown in FIG. 10, raising the seat 103 (relative to the toilet base 101) rotates the damper 107 relative to the clip 108 in the clockwise direction until an arm 171 of the damper 107 is stopped by the projection 182 of the clip 108. This initiates frictional rotation between the damper 107 and the hinge pin 106, and also places the anti-slam system into a "charged" state (i.e., being capable of preventing the seat from being slammed through damping/friction generated by the damper 107). As shown in FIG. 11, lowering the seat 103 (relative to the toilet base 101) rotates the damper 107 relative to the clip 108 in the counterclockwise direction.

During a first range of travel of the damper 107 (e.g., the lower arm 171 moving from the stop position up to contact with a ramped surface 181 of the clip 108) in the counterclockwise direction, the damper 107 (e.g., the arm 171) and the clip 108 can provide a first force (e.g., friction force, damping force, both), which can be zero for the arrangement of a gap between the end of the arm 171 and the inner diameter of the body 180 or can be greater than zero for the arrangement having a predetermined interference fit between the arm 171 and the body 180.

During a second range of travel of the damper 107 (e.g., after contact between an arm 171 and a ramped surface 181 of the clip 108), the damper 107 (e.g., the arm 171) and the clip 108 can provide a second force (e.g., friction force, damping force, both), which is greater than the first force. Thus, the interactions between the damper 107 and the clip 108 and the damper 107 and the hinge pin 106 can provide a first force that includes a damping force (e.g., compression force, spring force, etc.) and/or a friction force in response to a first level/amount of compression of the arms 171 by the clip 108 during the first range of travel. Again, the first force can be zero (i.e., for clearance, no compression) or greater than zero (i.e., first level of interference/compression). Similarly, these same interactions can provide a second force in response to a second level/amount of compression of the arms 171 by the clip 108, where the second force is greater than the first force.

The first range of travel of the damper 107 (e.g., with the arms 171 out of contact with the ramped surfaces 181) can correspond to a first range of travel of the seat 103 from the open position toward the closed position, and the second range of travel of the damper 107 (e.g., with the arms 171 contacting with the ramped surfaces 181) can correspond to a second range of travel of the seat 103 from the first range of travel to the closed position. As shown in FIG. 12, ramping of the arms 171 of the damper 107 onto the ramped surfaces 181 of the clip 108 increases the forces in a controlled manner between the damper 107 and the hinge pin 106/clip 108 to provide repeatable anti-slam functionality of the seat assembly.

Figure 13:
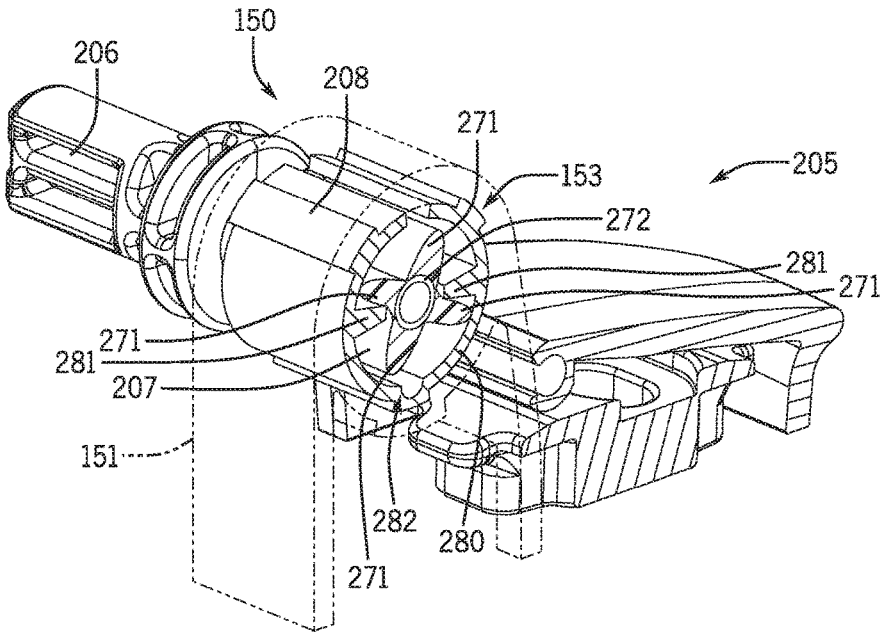
FIG. 13 is a perspective view of an exemplary embodiment of a toilet seat hinge, according to this application.
Figure 14:
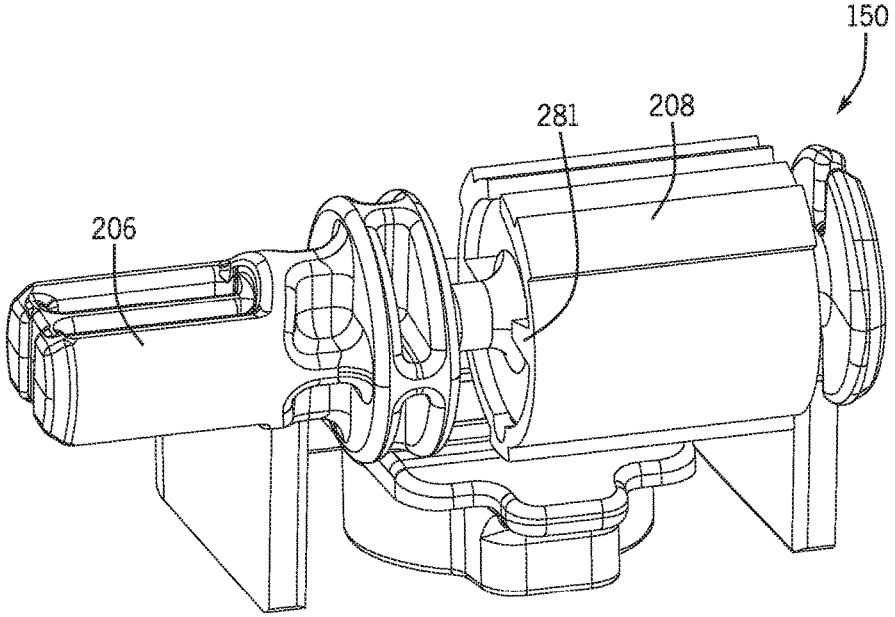
FIG. 14 is another perspective view of the toilet seat hinge shown in FIG. 13.
Figure 15:
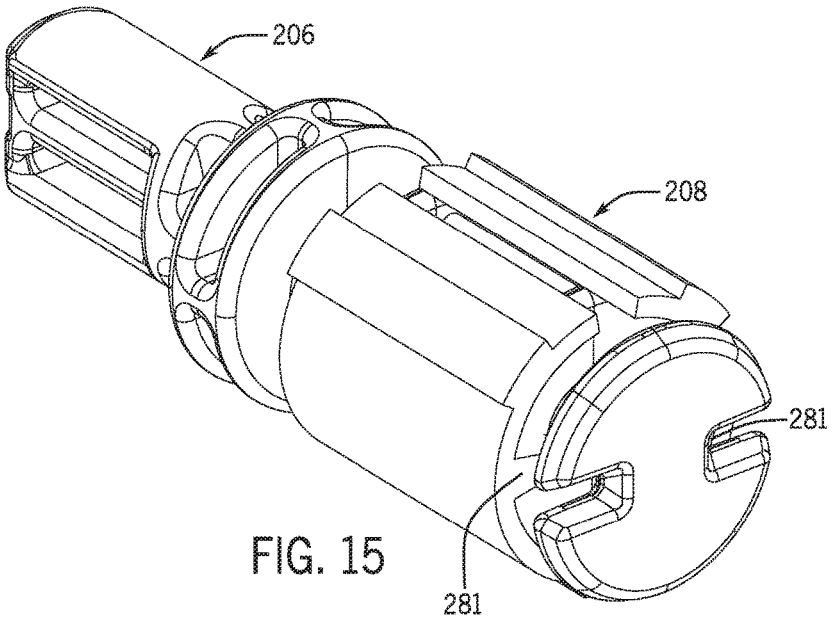
FIG. 15 is a perspective view of the damper assembly shown in FIGS. 13 and 14.
Figure 16:
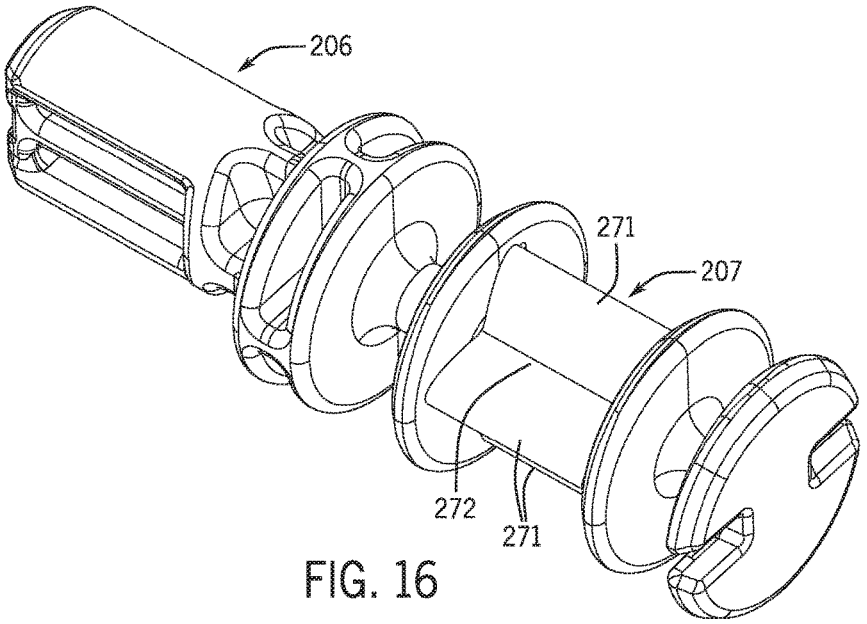
FIG. 16 is another perspective view of the damper assembly shown in FIGS. 13 and 14 with the clip removed.

FIGS. 13-16 illustrate an exemplary embodiment of a toilet seat hinge 205 that includes a hinge pin 206 disposed in the bore 153 of the body 151 of the hinge base 150, a damper 207 disposed in the bore 153 and rotatably mounted on the hinge pin 206, and a clip 208 disposed in the bore 153 between the body 151 and the damper 207. The hinge pin 206 rotatably couples a toilet seat/lid to a hinge base and is configured basically the same as the hinge pin 106 discussed above, unless noted otherwise. As shown in FIGS. 13 and 16, the damper 207 is configured similar to the damper 107 discussed above, except the damper 207 has a cross-sectional shape that is basically a four pointed star, with four fingers 271 (e.g., arms) extending away from a central portion 272 that is rotatably coupled to a shaft of the hinge pin 206. As shown in FIGS. 13-15, the clip 208 is configured similar to the clip 108 discussed above, except the clip 208 has two projections 281 extending inwardly from an inner diameter of the body 280 that cooperate with the fingers 271 of the damper 207 to provide damping/friction force(s), and the clip 208 includes an inner channel 282 in the body 280. The channel 282 is shown in FIG. 13 as a concave recess that extends along the longitudinal length of the clip 208. The channel 282 is configured to receive an end of one finger 271 when the finger 271 is aligned with the channel 282. It is noted that the reduction to two arms/ribs (e.g., the damper 107 illustrated in FIGS. 5-12) lessened the material usage and cost compared to the damper 207. Further, the dampers having a shoulder (e.g., shoulder 174) and a "T" shaped arm/rib (e.g., arm 171 with a radial member 172 and a transverse member 173) had a greater effectiveness compared to the dampers without (e.g., the damper 207).

Figure 17:
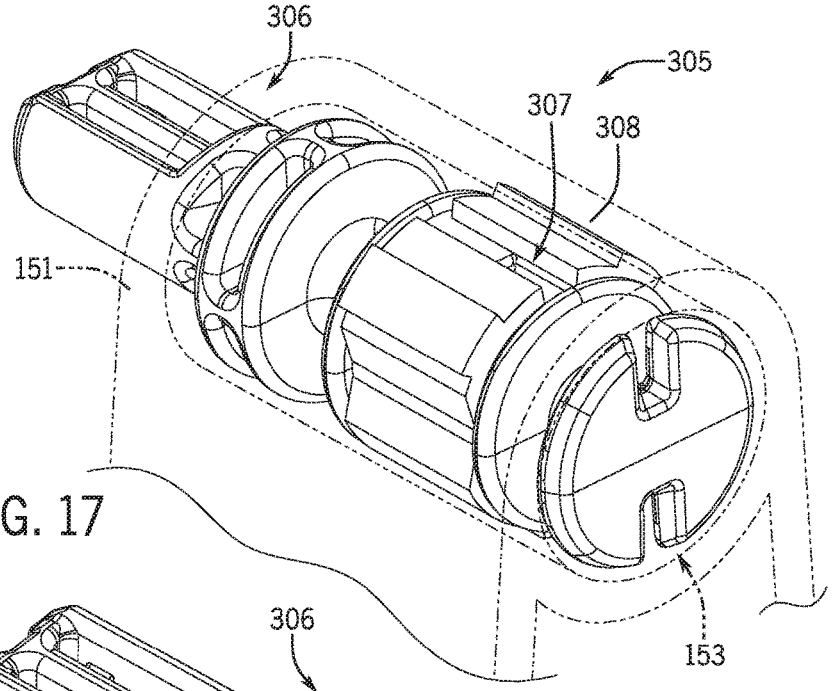
FIG. 17 is a perspective view of an exemplary embodiment of a toilet seat hinge, according to this application.
Figure 18:
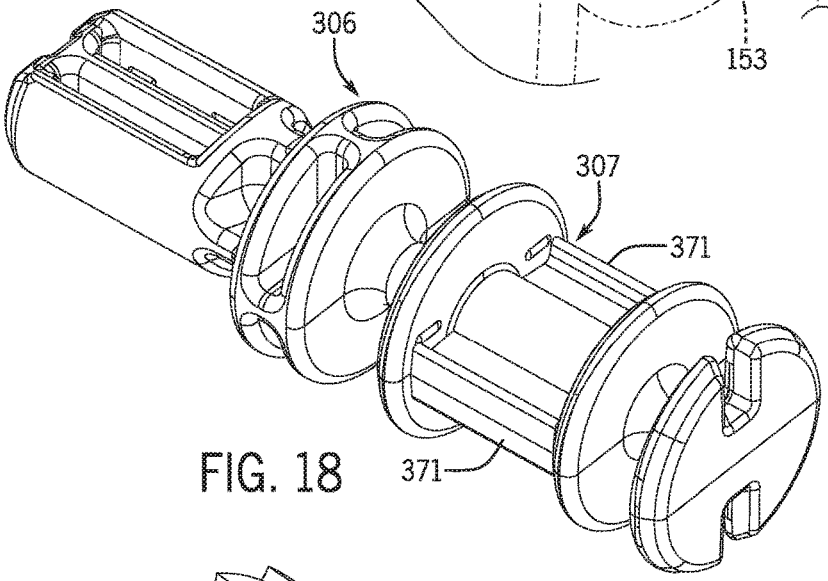
FIG. 18 is a perspective view of the damper assembly shown in FIG. 17.
Figure 19:
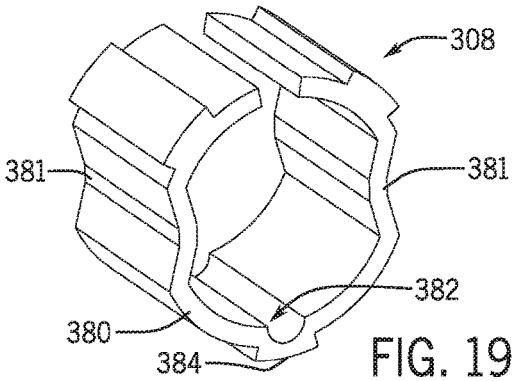
FIG. 19 is a perspective view of the clip shown in FIG. 17.
Figure 20:
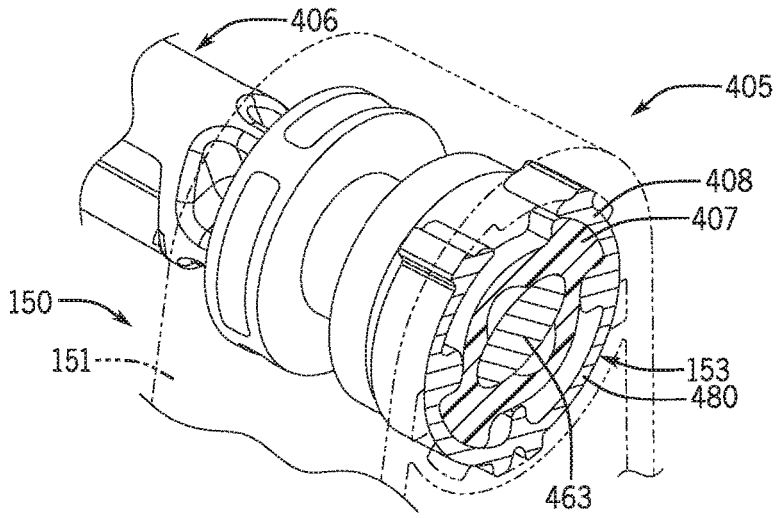
FIG. 20 is a perspective view of an exemplary embodiment of a toilet seat hinge having a damper assembly, according to this application.

FIG. 17 illustrates an exemplary embodiment of a toilet seat hinge 305 that includes a hinge pin 306 disposed in the bore 153 of the body 151 of a hinge base, a damper 307 disposed in the bore 153 and rotatably mounted on the hinge pin 306, and a clip 308 disposed in the bore 153 between the body 151 and the damper 307. The hinge pin 306 rotatably couples a toilet seat/lid to the hinge base, and the hinge pin 306 is configured basically the same as the hinge pin 106 discussed above, unless noted otherwise. As shown in FIG. 18, the damper 307 is configured basically the same as the damper 107 discussed above, unless noted otherwise. The damper 307 includes two arms 371 like that of the damper 107. The end surface of each arm 371 can be curved (e.g., semi-circular having an outer diameter) or can be wedge shaped (e.g., having inclined surfaces that meet at a surface or along a line, pointed). As shown in FIG. 19, the clip 308 is configured similar to the clip 108 discussed above, except where noted otherwise. One difference is the clip 308 has two wedge shaped projections 381 extending inwardly from an inner diameter of the body 380 that cooperate with the arms 371 of the damper 307 to provide a damping force and/or a friction force. Each projection 381 includes a flat inner portion and an inclined portion extending (at an oblique angle relative to the flat portion) from each end of the flat portion to the body 380. Another difference is the clip 308 includes an inner channel 382 in the body 380. The channel 382 is shown in FIG. 19 as a concave recess that extends along the longitudinal length of the clip 308. The channel 382 is configured to receive an end of an arm 371 when the arm 371 is aligned with the channel 382. The channel 382 advantageously provides for easier assembly of the clip 308 by allowing the part to intentionally flex at the location of the channel 382 similar to a living hinge design feature. Yet another difference is the clip 308 includes a single tab 384 at the bottom of the body 380 (as shown in FIG. 19), where the clip 108 has two spaced apart tabs 184. The tab 384 engages a mating channel in the body 151 to couple the clip 308 to the body 151 in the bore 153.

Figure 21:
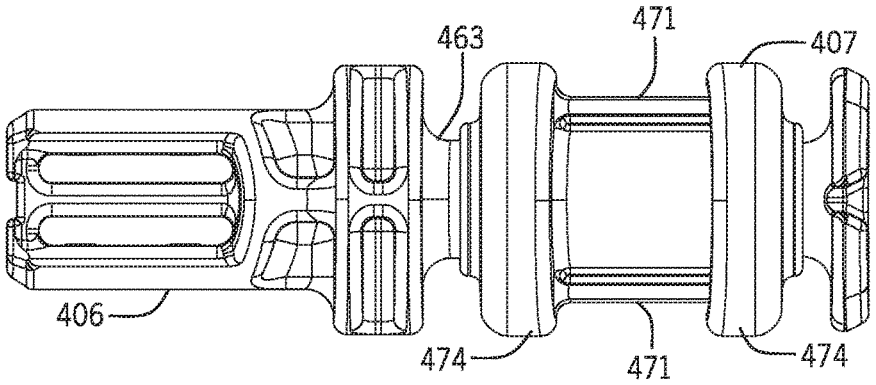

FIGS. 20-25 illustrate an exemplary embodiment of a toilet seat hinge 405 that includes a relatively rigid hinge pin 406 disposed in the bore 153 of the body 151 of a hinge base 150, a relatively resilient damper 407 disposed in the bore 153 and rotatably mounted on the hinge pin 406, and a hinge clip 408 disposed in the bore 153 between the body 151 and the damper 407. As shown best in FIG. 23, the hinge pin 406 includes a shaft 463 that has an oval cross-sectional shape (e.g., as opposed to circular, annular, etc.), which advantageously provides a variable compression on the damper 407, which in-turn provides a variable torque resistance (e.g., increase torque resistance). As shown in FIG. 21, the damper 407 can be formed over (e.g., overmolded onto) the oval shaft 463 such that the damper 407 extends longitudinally beyond (e.g., past) one or more of the annular ribs (e.g., the first annular shoulder 164, the second annular shoulder 165) to advantageously seal the hinge base (e.g., the chamber of the hinge base in which the damper 407 is located within).

Figure 22:
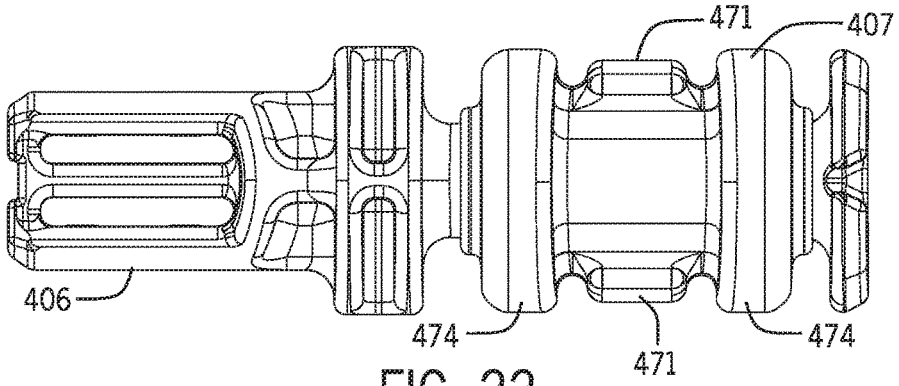
FIG. 22 is a plan view of another damper assembly for use with the toilet seat hinge shown in FIG. 20.

This advantageously seals the chamber in which the compression and friction occur, thereby making the system more repeatable. The arms 471 of the damper 407 are shown in FIG. 21 extending between and contacting the insides of the annular ends 474, which are formed over the annular ribs, whereas the arms 471 of the damper 407 are shown in FIG. 22 to extend between the annular ends 474 without contacting the insides. The damper 407 is configured to improve tear resistance and control the reaction forces (e.g., to the center axis of the hinge pin 406).

The hinge clip 408 includes a C-shaped body 480 having a substantially uniform inner diameter and outer diameter that is open at one end. Extending radially inward from two opposite sides of the inner diameter of the body 480 are two generally rectangular shaped projections 481, which are configured to limit angular rotation of the damper 407 relative to the hinge clip 408. Extending radially inward from the body 480 at a location between the two projections 481 is a third projection 482 that may cooperate with one or both of the projections 481 to further limit relative angular rotation between the damper 407 and the hinge clip 408. One or more tabs 484 may extend radially outward from the outer diameter of the body 480, such that each tab 484 engages an associated channel 154 in the hinge base 150 to prevent relative rotation between the hinge clip 408 and the hinge base 150.

Figure 23:
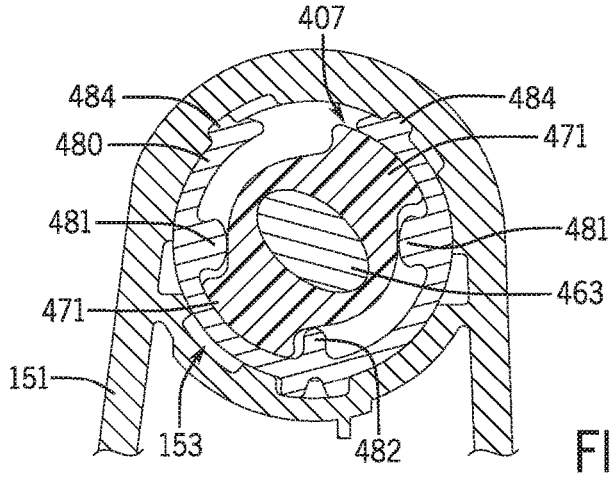
FIG. 23 is an end view of the toilet seat hinge shown in FIG. 20 in a first position.
Figure 24:
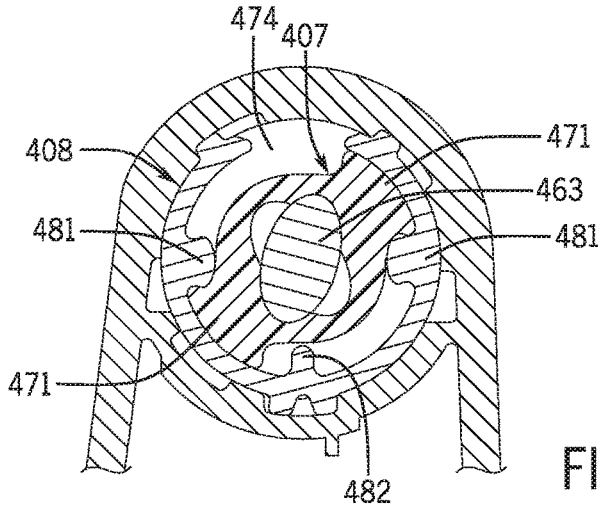
FIG. 24 is an end view of the toilet seat hinge shown in FIG. 20 in a second position.
Figure 25:
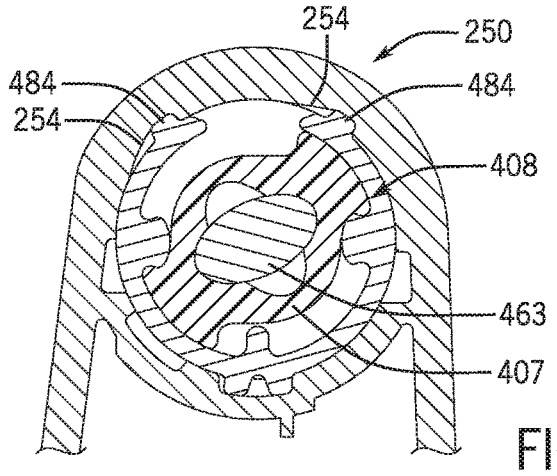
FIG. 25 is an end view of the toilet seat hinge shown in FIG. 20 in a third position.

As shown in FIG. 23, after over-molding the damper 407 onto the hinge pin 406, the oval shaft 463 of the rigid hinge pin 406 is aligned to the overmold to create a non-uniform TPE material thickness. That is, creation of a non-uniform cross-sectional area of the arm(s) 471 of the damper 407 via the oval shaped pin enables an increased quantity of material (e.g., elastomer, etc.) to be available and compressed when the pin 406 rotates independently of the damper 407. An increased volume of each arm 471 provides more damper material, which acts akin to a larger spring element providing additional variable torque resistance, and the oval geometry incrementally applies a greater quantity of radial compression due to the increased interference seen during relative rotation between the elements (e.g., the damper 407 and the pin 406 and/or the clip 408. As shown in FIG. 24, upon rotation of the hinge pin 406 while the damper 407 is restrained by the projections 481, 482, the oval shaped shaft 463 of the hinge pin 406 will rotate relative to and out of phase with the oval shape of the damper 407 molded onto the hinge pin 406, which compresses the flexible damper 407 (e.g., the arms 471 thereof) in reshaping the opening of the damper to create a variable compression load while the friction between the elements generates a variable torsional resistance. This variable compression load and torsional resistance can be in addition to forces created between the hinge clip 408 and the damper 407, such as or similar to those discussed above for the other embodiments. It is noted that additional forces (e.g., compression, friction) can be introduced into the damper/hinge systems of this application. By way of non-limiting example, the channels 254 can be ramped to create a ramped engagement between the hinge clip 408 and the hinge base 250 that resist rotation of the hinge clip 408, such as by reducing/increasing (depending on the rotational direction) the diameter at the ends of the hinge clip 408 as the tabs 484 move along the ramp surfaces of the hinge base 250, as shown in FIG. 25. The system can be configured so that the radial compression will be highest when a relatively large torque (e.g., during slamming of the seat) is applied, such as by having the greatest amount of interference between the elements. Also by way of non-limiting example, additional forces can be generated/introduced by changing further round surfaces (e.g., exterior surfaces of the damper, interior/exterior surfaces of the hinge clip, the interior surfaces of the hinge base, etc.). For example, a system can be configured so that when the seat is open, the ovals would align without interference (e.g., be in phase), and after rotating close, interference would be greatest when the ovals are perpendicular (e.g., about ninety degrees out of phase). By providing a damper having a material (e.g., TPE/TPU resin) that does not bond (e.g., chemically) to the hinge pin (e.g., its material), the hinge 405 provides improved toughness (tear resistance), waxiness (surface tension), and durometer while providing the desired torque resistance and the required interference tolerance requirements.

Figure 26:
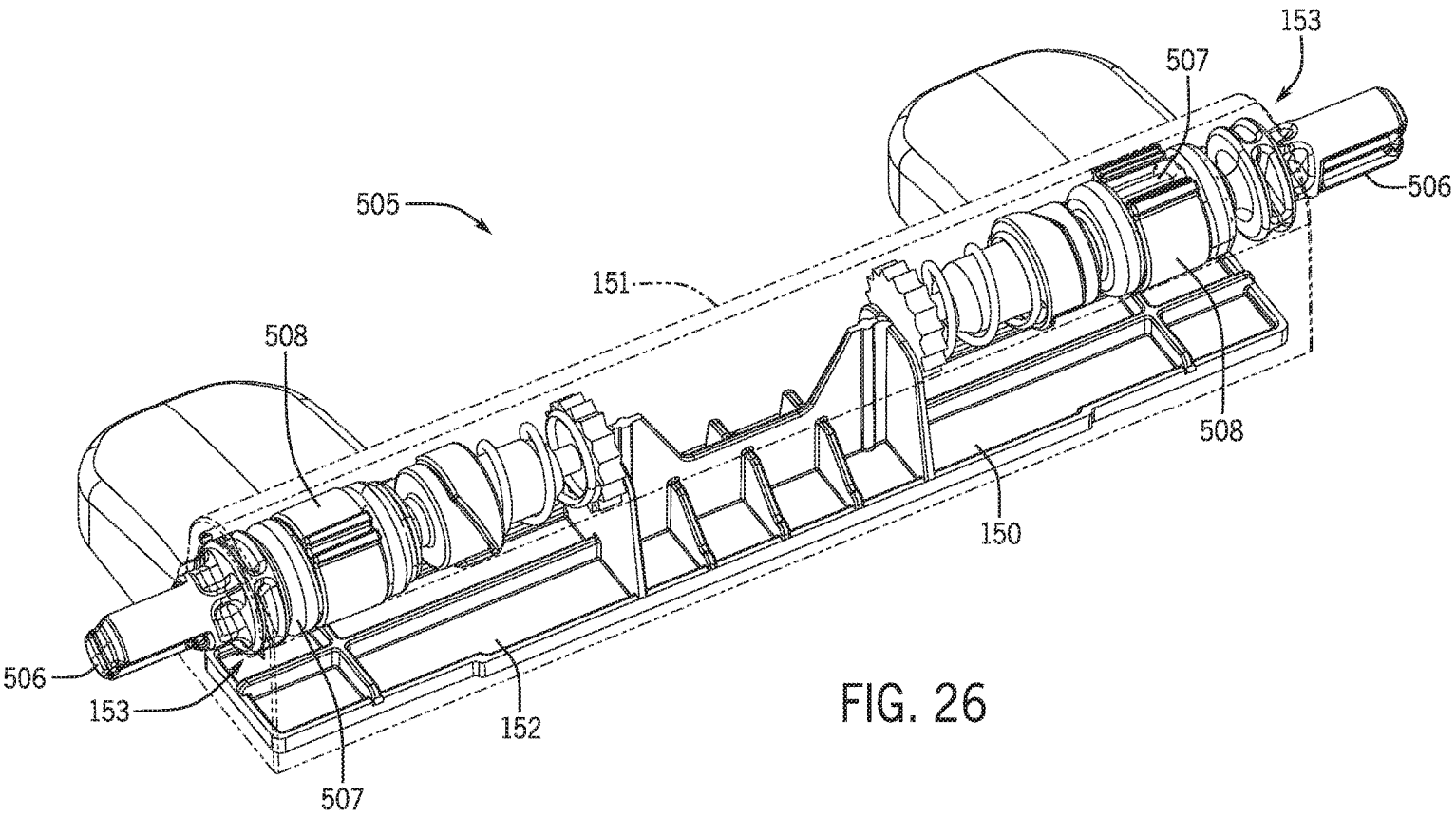
FIG. 26 is perspective view of a hinge, according to this application.

FIGS. 26-30 illustrate an exemplary embodiment of a toilet seat hinge 505 that includes a spring element that provides counter torque and/or frictional resistance in addition to the force(s) from the damper. As shown in FIG. 26, the hinge 505 includes a hinge base (e.g., the hinge base 150) with a bore (e.g., the bore 153) in each of two opposite sides, where each bore 153 receives a hinge pin assembly. Each hinge pin assembly includes a relatively rigid hinge pin 506, a relatively resilient damper 507 rotatably mounted on the hinge pin 506, and a hinge clip 508 disposed around part of the damper 507 and received by the hinge base 150 in the associated bore 153. The damper 507 and the hinge clip 508 are shown configured the same as the damper 407 and the hinge clip 408, respectively described above, so no further description is provided here for the damper 507 and the hinge clip 508. Although, it is noted that any damper and/or clip described herein can be utilized with the spring element shown in FIGS. 26-30.

Figure 27:
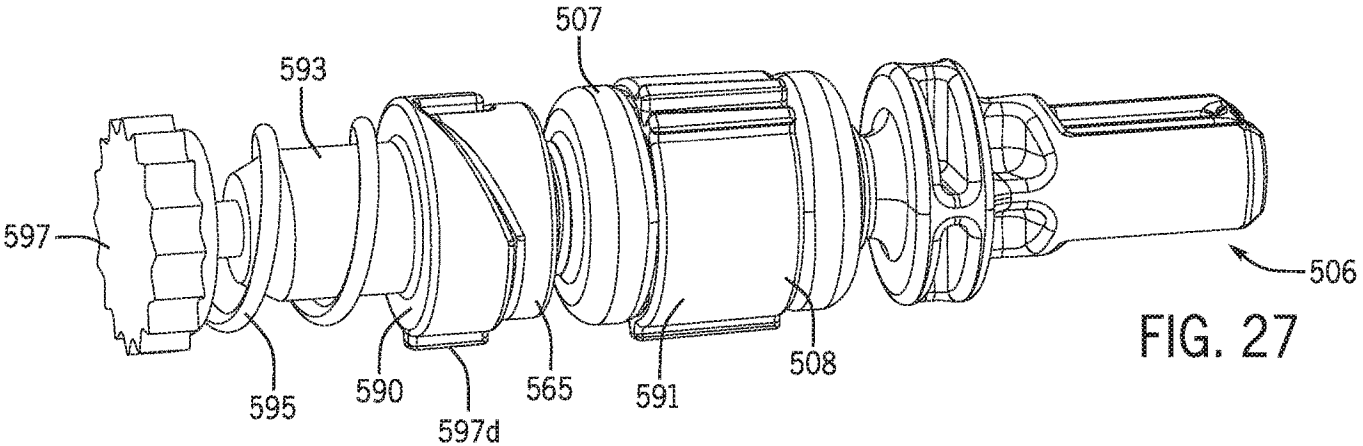
FIG. 27 is a perspective view of part of the hinge shown in FIG. 26 in an open position.
Figure 28:
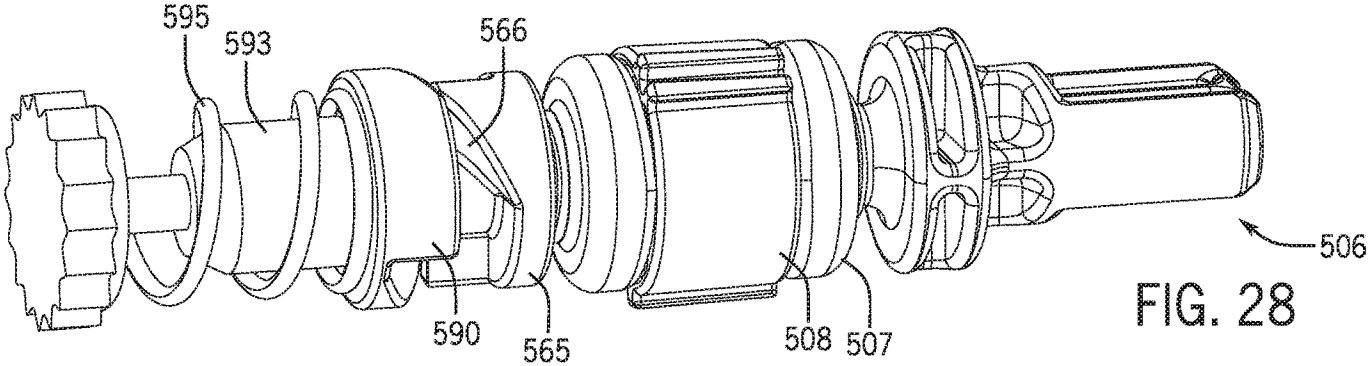
FIG. 28 is a perspective view of part of the hinge shown in FIG. 26 in a closed position.

The hinge pin 506 is basically the same as the hinge pin 406 described above, except that the hinge pin 506 further includes a cam 565 disposed on the inner end (opposite the part that extends out from the hinge base). As shown in FIGS. 27-30, the cam 565 includes a ramped surface 566 (e.g., a helical sweep ramp) that is configured to drive linear movement of a cam follower 590 (e.g., cam piston) upon rotation of the cam 565, which rotates with the hinge pin 506. The cam follower 590 has a lobe 591 shaped to nest with the ramped surface 566 (e.g., the shape of the lobe 591 can complement the shape of the ramped surface 566) so that the cam 565 and cam follower 590 are in a first relative position (e.g., open position, uncompressed position), as shown in FIG. 27. Also shown in FIG. 27, the hinge 505 further includes a spring 595 (shown as a helical compression/coil spring), which is wound around a post 593 of the cam follower 590, and a stop 597, which can be coupled (e.g., fixedly coupled) to the hinge base and/or threaded to the hinge pin 506.

Figure 29:
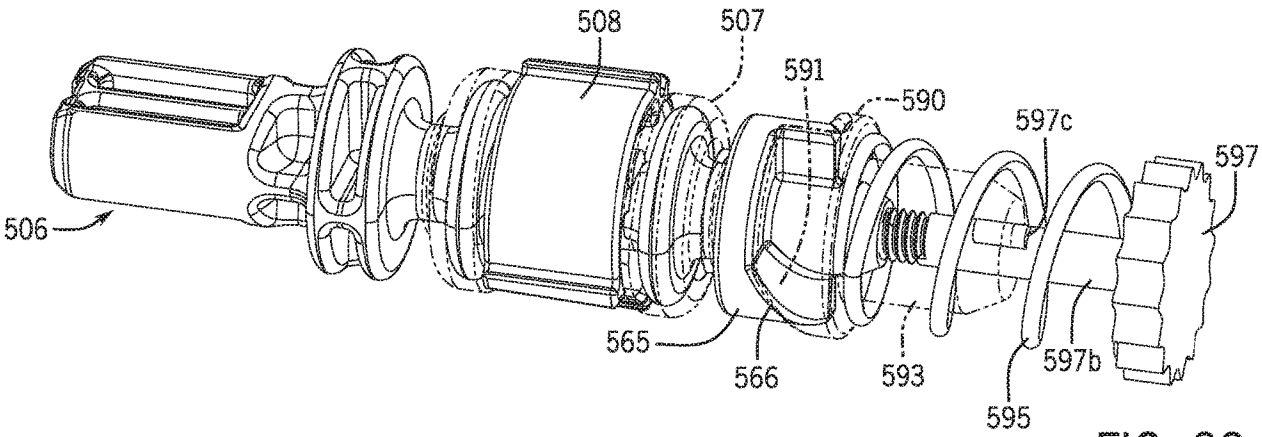
FIG. 29 is another perspective view of part of the hinge shown in FIG. 26.
Figure 30:
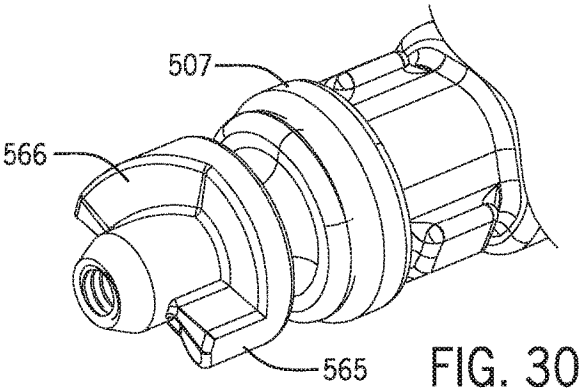
FIG. 30 is yet another perspective view of part of the hinge shown in FIG. 26.

In general, the cam follower 590 has a geometry that restricts or prevents rotation of the cam follower 590 relative to the stop 597 and the hinge pin 506. By way of example, the stop 597 can be configured to prevent relative rotation between the cam follower 590 and the stop 597, such as by having a shaft 597*b* with a key-way 597*c* (e.g., rib, one or more splines, etc.) that engages a channel (e.g., groove) in the post 593 of the cam follower 590 as illustrated in FIG. 29. Also, by way of example, the cam follower 590 can include a rib 597*d* (e.g., one or more splines, etc.) as illustrated in FIG. 27 that engages a channel in the hinge base (e.g., such as a channel 154, 254). These arrangements allow the cam follower 590 to move axially (e.g., longitudinally) toward and away from the stop 597 upon relative rotation between the hinge pin 506 and the cam follower 590. In this way, rotation of the hinge pin 506 rotates the cam 565 (and the ramped surface 566) relative to the cam follower 590 (and the lobe 591) so that the lobe 591 follows along the ramped surface 566 moving the cam follower 590 (through the lobe 591) axially relative to the stop 597 and the damper 507. When the cam follower 590 moves axially toward the stop 597, the spring 595 is wound and compressed increasing its loading (axial and torsional). In the closed position (e.g., compressed position) shown in FIG. 28, the cam follower 590 is closest to the stop 597 and the spring 595 is at maximum compression. Rotation of the hinge pin 506 from the closed position toward the open position shown in FIG. 27, which corresponds to the cam follower 590 being farthest from the stop 597 and the spring 595 at minimum compression, moves the cam follower 590 away from the stop 597 and unwinds the spring 595 to reduce the compression of (e.g., uncompresses, decompresses, etc.) the spring 595. The winding/compression and unwinding/decompression of the spring 595 creates counter torque (e.g., due to the cam surfaces), which can increase the total friction torque resistance in the system or allow a lower frictional torque resistance required from the internal damping geometries in the system without a reduction in the total friction torque resistance.

With reference back to FIG. 26, the base member 152 (e.g., a bottom hinge plate) and the hinge cover (e.g., the body 151) of the hinge base 150 contain one damper assembly within each of the two bores 153 therein. Each bore 153 can be defined by the body 151 alone or in combination with the base member 152. The size of each bore 153 can be made to accommodate different sized damper assemblies. Further, the stop locations in the hinge base 150 can be varied to accommodate damper assemblies having tailored sizes. Alternatively, the bottom hinge plate and/or the hinge cover can be designed with adjustable damper stop locations to allow the closure rate to be adjusted before/after assembly, such as by a homeowner and/or installer. Another variant or method to create counter torque and increased variable frictional torque resistance is for the cam to be part of the damper (e.g., integrally formed therewith, formed separately and coupled thereto). For example, the cam and damper can be overmolded onto the hinge pin to create new and variable frictional forces on the hinge pin's rib when the pin rotates and compresses the spring.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the toilet seat hinges as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., hinge pin, damper, clip, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A toilet seat hinge comprising:

a hinge base mountable to a toilet base and comprising a body having a bore;

a hinge pin having a first portion, which is disposed in the bore, and a second portion, which extends outside of the bore and is configured to engage a toilet seat, wherein the hinge pin is rotatable relative to the body;

a damper comprising:

a sleeve rotatably mounted on the first portion; and an arm extending radially outward from the sleeve; and a clip disposed in the bore between the body and the damper, wherein the damper is rotatable relative to the clip such that in a first relative position, the arm is compressed a first amount by the clip to provide a first damping force, and in a second relative position, the arm is compressed a second amount, which is greater than the first amount, by the clip to provide a second damping force, wherein the arm is a first arm that extends radially outward from a first location on the sleeve, and the damper comprises a second arm extending radially outward from a second location on the sleeve, wherein each arm is compressed by the clip the first amount in the first relative position, and wherein each arm is compressed by the clip the second amount in the second relative position.

2. The toilet seat hinge of claim 1, wherein each arm comprises:

a radial member extending radially outward from the sleeve; and a transverse member disposed at an outer end of the radial member and extending transversely to the radial member.

3. The toilet seat hinge of claim 2, the damper comprises an elastomer.

4. The toilet seat hinge of claim 2, wherein the clip comprises:

an annular body having an inner surface; and two ramped surfaces extending inwardly of the inner surface from two separate locations of the body;

wherein each arm is aligned with the inner surface of the body in the first relative position, and each arm is aligned with one of the two ramped surfaces in the second relative position.

5. The toilet seat hinge of claim 4, wherein the two ramped surfaces are diametrically opposed.

6. A toilet seat hinge comprising:

a hinge base mountable to a toilet base and comprising a body having a bore;

a hinge pin having a first portion, which is disposed in the bore, and a second portion, which extends outside of the bore and is configured to engage a toilet seat, wherein the hinge pin is rotatable relative to the body;

a damper comprising:

a sleeve rotatably mounted on the first portion; and an arm extending radially outward from the sleeve; and a clip disposed in the bore between the body and the damper, wherein the clip comprises:

an annular body having an inner surface; and a ramped surface extending inwardly from the inner surface;

wherein the damper is rotatable relative to the clip such that in a first relative position, the arm is compressed a first amount by the clip to provide a first damping force, and in a second relative position, the arm is compressed a second amount, which is greater than the first amount, by the clip to provide a second damping force, and wherein the arm is aligned with the inner surface of the body in the first relative position, and the arm is aligned with the ramped surface in the second relative position.

7. The toilet seat hinge of claim 6, wherein the ramped surface is curved.

8. The toilet seat hinge of claim 6, wherein the ramped surface is wedge shaped.

9. The toilet seat hinge of claim 6, wherein the clip further comprises a projection extending inwardly from the inner surface of the body, wherein the projection is configured to limit rotational travel of the damper relative to the clip.

10. A toilet seat hinge comprising:

a hinge base mountable to a toilet base and comprising a body having a bore;

a hinge pin having a first portion, which is disposed in the bore, and a second portion, which extends outside of the bore and is configured to engage a toilet seat, wherein the hinge pin is rotatable relative to the body;

a damper comprising:

a sleeve rotatably mounted on the first portion; and an arm extending radially outward from the sleeve; and a clip disposed in the bore between the body and the damper;

wherein the damper is rotatable relative to the clip such that in a first relative position, the arm is compressed a first amount by the clip to provide a first damping force, and in a second relative position, the arm is compressed a second amount, which is greater than the first amount, by the clip to provide a second damping force, wherein the first portion of the hinge pin comprises:

a shaft on which the sleeve is rotatably mounted; and two shoulders that are spaced apart and extend radially outward from opposite ends of the shaft.

11. The toilet seat hinge of claim 10, wherein the damper comprises two shoulders that are spaced apart and extend radially outward from the sleeve, each shoulder of the damper is adjacent to one shoulder of the first portion, and the arm extends longitudinally between the two shoulders of the damper.

12. A toilet seat hinge comprising:

a hinge base comprising a body having a bore;

a hinge pin having a portion disposed in the bore, wherein the hinge pin is rotatable relative to the body;

a damper rotatably mounted on the portion of the hinge pin, the damper comprising a plurality of arms extending radially away from the hinge pin; and a clip disposed in the bore between the body and the damper, the clip comprising a body and a plurality of projections extending inwardly from the body of the clip;

wherein rotation of the damper relative to the clip with the plurality of arms contacting the plurality of projections provides a first damping force, and rotation of the damper relative to the clip with the plurality of arms separated from the plurality of projections provides a second damping force that is less than the first damping force.

13. The toilet seat hinge of claim 12, wherein the plurality of arms comprises a first arm and a second arm, which extend from opposite sides of a sleeve of the damper, and wherein the sleeve surrounds the portion of the hinge pin.

14. The toilet seat hinge of claim 13, wherein the plurality of projections comprises a first projection and a second projection, which are diametrically opposed, and each projection is curved.

15. The toilet seat hinge of claim 13, wherein the plurality of projections comprises a first projection and a second projection, which are diametrically opposed, and each projection is wedge shaped.

16. The toilet seat hinge of claim 13, wherein each of the first and second arms comprises a radial member and a transverse member at the end of the radial member.

17. The toilet seat hinge of claim 12, wherein the plurality of arms comprises a first arm, a second arm, a third arm, and a fourth arm.

18. The toilet seat hinge of claim 17, wherein each of the second and third arms are offset from each of the first and fourth arms by about ninety degrees about an axis of rotation of the damper.

19. The toilet seat hinge of claim 17, wherein the plurality of projections comprises a first projection and a second projection diametrically opposed from the first projection.

20. A toilet seat assembly, comprising:

a toilet seat; and the toilet seat hinge of claim 12, which is configured to rotatably couple the toilet seat to a toilet base of a toilet.

* * * * *